United States Patent [19]

Patten

[11] 4,441,587

[45] Apr. 10, 1984

[54] INTERNAL COMBUSTION ENGINE OR PUMPING DEVICE

[76] Inventor: Kenneth S. Patten, 1920 Latham St., #1, Mountain View, Calif. 96040

[21] Appl. No.: 404,536

[22] Filed: Aug. 2, 1982

Related U.S. Application Data

[62] Division of Ser. No. 111,489, Jan. 14, 1980, Pat. No. 4,362,477.

[51] Int. Cl.[3] ..... F16D 55/02

[52] U.S. Cl. ..... 188/70 R

[58] Field of Search ..... 92/85 R; 188/67, 70 R, 188/187, 189, 365, 378

[56] References Cited

U.S. PATENT DOCUMENTS

| | | | |
|---|---|---|---|
| 2,228,411 | 1/1941 | Sheridan . | |
| 2,465,810 | 3/1949 | MacDonald et al. | 188/70 R X |
| 2,581,600 | 1/1952 | Pescara . | |
| 2,626,001 | 1/1953 | Antle, Jr. . | |
| 3,031,972 | 5/1962 | Janicke . | |
| 3,106,896 | 10/1963 | Van Der Lely et al. . | |
| 3,182,895 | 5/1965 | Panhard . | |
| 3,195,669 | 7/1965 | Court . | |
| 3,214,085 | 10/1965 | Boldt . | |
| 3,351,147 | 11/1967 | Williamson . | |
| 3,414,187 | 12/1968 | McMullin et al. . | |
| 3,432,088 | 3/1969 | Steiger . | |
| 3,983,699 | 10/1976 | Hanis . | |
| 4,115,037 | 9/1978 | Butler . | |

*Primary Examiner*—Duane A. Reger

*Attorney, Agent, or Firm*—Fitch, Even, Tabin & Flannery

[57] ABSTRACT

An internal combustion engine or pumping device is disclosed including a block forming a plurality of cylinders, each divided into a combustion chamber and a pumping chamber by a reciprocable piston, energy developed by internal combustion within the combustion chamber being transferred directly through the piston for pressurizing transmission drive fluid in the pumping chamber which is then communicated through a high pressure conduit for performing useful work and returned to the engine through a low pressure conduit. The engine or pump preferably includes pairs of such pistons which are mechanically interconnected for operation in opposition to each other. Couplings and controls synchronize operation of the pistons and regulate fuel and air supply to the combustion chambers. The engine is also equipped with a number of systems for preventing piston overtravel, particularly a self-actuating brake which is also novel apart from the present engine or pumping device.

4 Claims, 10 Drawing Figures

FIGURE 4
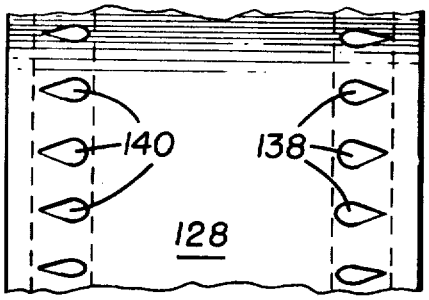
FIGURE 10
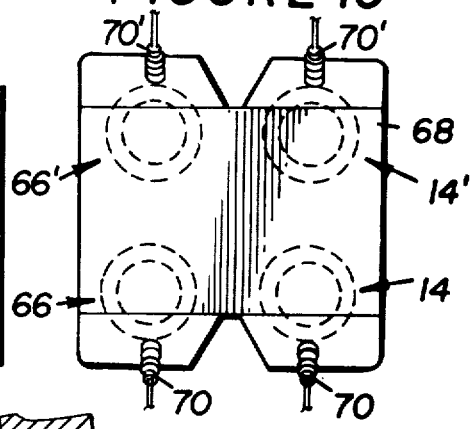
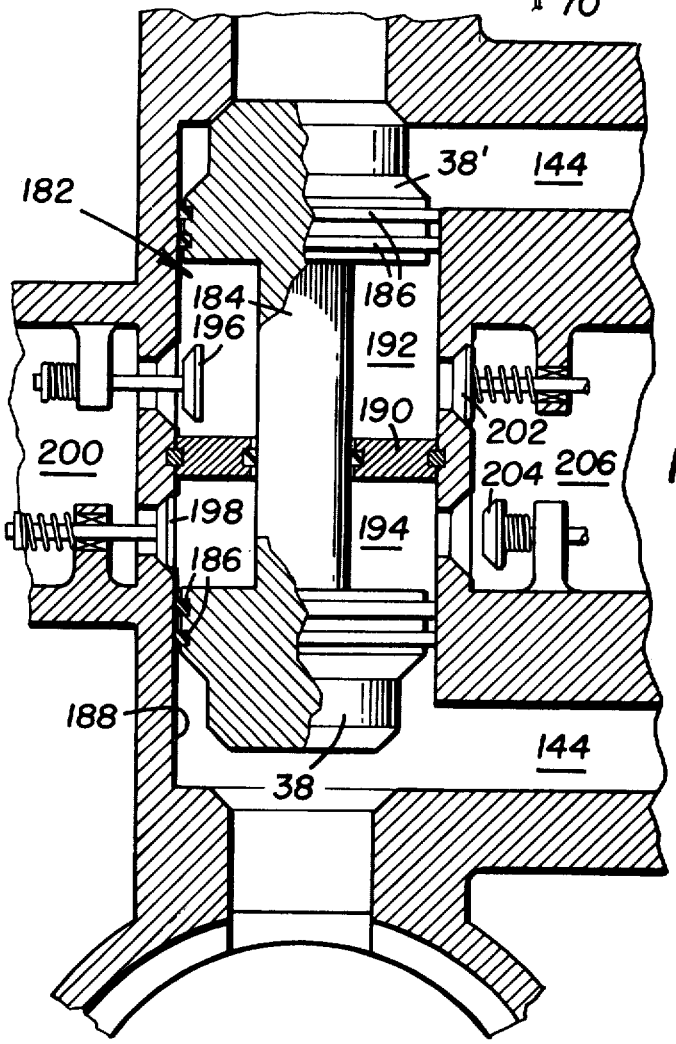
FIGURE 5

INTERNAL COMBUSTION ENGINE OR PUMPING DEVICE

This is a division, of application Ser. No. 111,489, filed Jan. 14, 1980 now U.S. Pat. No. 4,362,477.

BACKGROUND OF THE INVENTION

The present invention relates to an internal combustion engine or pumping device and more particularly to such an engine or pumping device including one or more pistons or power elements through which energy is transferred direcily from a combustion chamber to pressurize a transmission drive fluid in a pumping chamber.

Prior art engines adapted for pressurizing a fluid to perform useful work have generally employed an engine-driven reciprocating air compressor or pump. In such prior art arrangements, the engine is connected to a compressor or pump in such a manner that power from its pistons or power elements is transferred to the compressor or pump through a complex arrangement of crankshafts, connecting rods and the like, for example. These parts, with their associated bearings, bushings, crankshaft journals and counterweights, contribute considerable mass and weight which results in a concomitant loss of efficiency. Prior art systems of this type may employ a conventional internal combustion engine, a diesel engine or even a rotary engine of the WANKEL type. Conventianal internal combustion engines are relatively unsatisfactory for such applications because they operate at relatively low compression ratios and with low efficiency, due in part to mechanical power transmission components such as those summarized above. The use of a diesel engine in such a system results in higher efficiency due both to higher compression ratios within the engine as well as ability of the engine to operate over long periods of time with reduced maintenance. However, these advantages are offset in part because of the greater weight of such engines and the continued need for transferring energy from the diesel engine to a compressor, pump or other means for performing useful work. The rotary engine in turn may also have certain advantages and disadvantages. However, it also has been used in the prior art with mechanical linkages for interconnecting te engine with suitable means for performing useful work.

Substantial effort has also been expended in the prior art to develop free-piston engines for such applications. Free-piston engines have been designed which directly connect an opposed pair of driving pistons for powering a compressor or pump. In this regard, reference is made to U.S. Pat. No. 3,432,088 issued Mar. 11, 1969; U.S. Pat. No. 2,581,600 issued Jan. 8, 1952; U.S. Pat. No. 3,031,972 issued May 1, 1962 and U.S. Pat. No. 4,115,037 issued Sept. 19, 1978. Each of these prior art references discloses an opoosed piston arrangement in engines adapted for operating compressors, pumps or the like. However, it may be seen that such free-piston engines have required relatively complex control systems in order to prevent excessive piston stroke or travel as well as to prevent excessive compression within the combustion chambers of the engines. Certain free-piston engines have also used mechanical linkages such as connecting rods, flywheels and the like for limiting piston travel and for power transmission. Other inherent difficulties for free-piston engines have related to problems of phase control or svnchronization, the need for heavy and complex auxiliary starting mechanisms and the need for precise speed control because of the mass of moving parts and high pressures. At the same time, the lack of rotary motion has made it difficult to incorporate cooling means for overcoming high temperatures developed in the engines.

Accordingly, there has been found to remain a need for an efficient engine or pumping system eliminating the need for heavy transmission means for interconnecting the engine with a compressor or pump. At the same time, a need exists for such efficient engines to be used as a prime mover in vehicles, marine propulsion units, construction machinery, electric generators and the like for performing useful work.

SUMMARY OF THE INVENTION

It is therefore an object of the present invention to provide an efficient internal combustion engine or pumping device wherein one or more pistons or power elements are movable within the internal combustion engine for forming a combustion chamber and a pumping chamber on opposite sides thereof, a transmission drive fluid being supplied to the pumping chamber during a stroke of the piston or power element, energy from internal combustion taking place within the combustion chamber being transferred directly through the piston for pressurizing the transmission drive fluid which may then be communicated through a high pressure fluid conduit for performing useful work.

In most applications, it is believed that the engine or pumping device will form a plurality of pistons or power elements which are operable in synchronization. However, it is also to be understood that an engine or pumping device may be constructed having a single piston or power element. For example, the power element could be a rotary flywheel or the like having sufficient inertia for continued operation. A single piston or power element could also be used for operating a pile driver or the like where the means driven by the engine would supply power for the compression stroke of the piston or power element.

In accordance with the above objective, the present invention may preferably be embodied in various types of internal combustion engines including diesel engines or even rotary engines as well as conventional internal combustion engines having a plurality of pistons or power elements. The primary advantage to be achieved from use of this combination results from the direct communication of energy across each piston from a combustion chamber to a pumping chamber by means of the piston or power element for pressurizing a transmission drive fluid. Through such an arrangement, the need for heavy transmission components for interconnecting the pistons or power elements with normal means for performing useful work is entirely avoided. Rather, the transmission function is performed by the transmission drive fluid itself.

It is a further object of the invention to provide such an internal combustion engine or pumping device wherein the pistons or power elements are interconnected for various purposes. Initially, it is contemplated that pairs of pistons arranged for reciprocation in separate combustion/pumping chambers be interconnected by a suitable mechanical linkage for synchronizing movement or operation of the two pistons or power elements. For example, the pistons could be interconnected by means of a simple rigid shaft or by means of a conventional crankshaft or the like. In any event, the mechanical coupling between the pistons is of substantially reduced mass since it does not transfer energy developed within the combustion chamber but rather serves only to synchronize operation of the pistons or power elements.

It is also an object of the present invention to equip the engine or pumping device with additional components for facilitating operation and regulation thereof. For example, the engine or pumping device preferably includes integral synchronization and control means as well as an integrally operated compressor for supplying compressed air to the combustion chambers, both for purposes of scavenging exhaust products from the combustion chambers and to better regulate and support combustion therein.

The present invention presents a distinct advantage over existing systems because of the direct fluid drive transmission noted above which in turn permits a substantial improvement in the power-to-weight ratio for engines or pumping devices of a large variety of sizes and horsepower ratings. The present invention also presents a distinct advantage over other free-piston engine concepts in that the engine pistons are preferably of hollow construction, the drive transmission fluid also serving as a coolant for the pistons and adjacent components.

Useful work in the form of pumping action to pressurize a drive transmission fluid is accomplished during the power stroke of each of the plurality of pistons or power elements within the engine. Since the pistons serve to directly transfer energy from the combustion chamber to the pumping chamber, the present engine or pumping device is capable of much greater efficiency of operation while also permitting construction thereof with relatively lightweight components.

It will also be apparent from the following description that the engine or pumping device of the present invention may be adapted for operation with a very high compression ratio and accordingly at a high degree of efficiency while permitting the use of relatively low grade fuels with high flash points.

It is yet another object of the imvention to provide a plurality of different systems or means for preventing or limiting piston over-travel. For example, piston over-travel is limited in part because of the opposed arrangement of pistons as referred to above and also by the development of a pressurized fluid cushion as the pistons approach a limit of travel. It is particularly contemplated that the engine be equipped with a self-actuating brake for limiting travel of the piston in a given direction as it approaches a limit of travel. The self-actuating brake acts as a redundant means for assuring the prevention of piston over-travel in the event that such over-travel is not limited by the other means described above.

At the same time, the self-actuating brake of the present invention may also be employed in applications other than the engine or pumping device described herein. Accordingly, it is also an object of the present invention to provide a self-actuating brake for automatically limiting or preventing over-travel between components which are movable relative to each other.

Additional objects and advantages of the present invention will be apparent from the following description having reference to the accompanying drawings.

BRIEF DESCRIPTION OF THE DRAWINGS

FIG. 4 is a fragmentary view taken along section line IV—IV of FIG. 1.

FIG. 5 is a view taken along section line V—V of FIG. 1 while illustrating an alternate construction for one pair of valves within the internal combustion engine or pumping device.

FIG. 10 is a view taken from the left end of the engine or pumping device of FIG. 1 to illustrate a preferred eight cylinder configuration.

DESCRIPTION OF THE PREFERRED EMBODIMENTS

Figure 1:
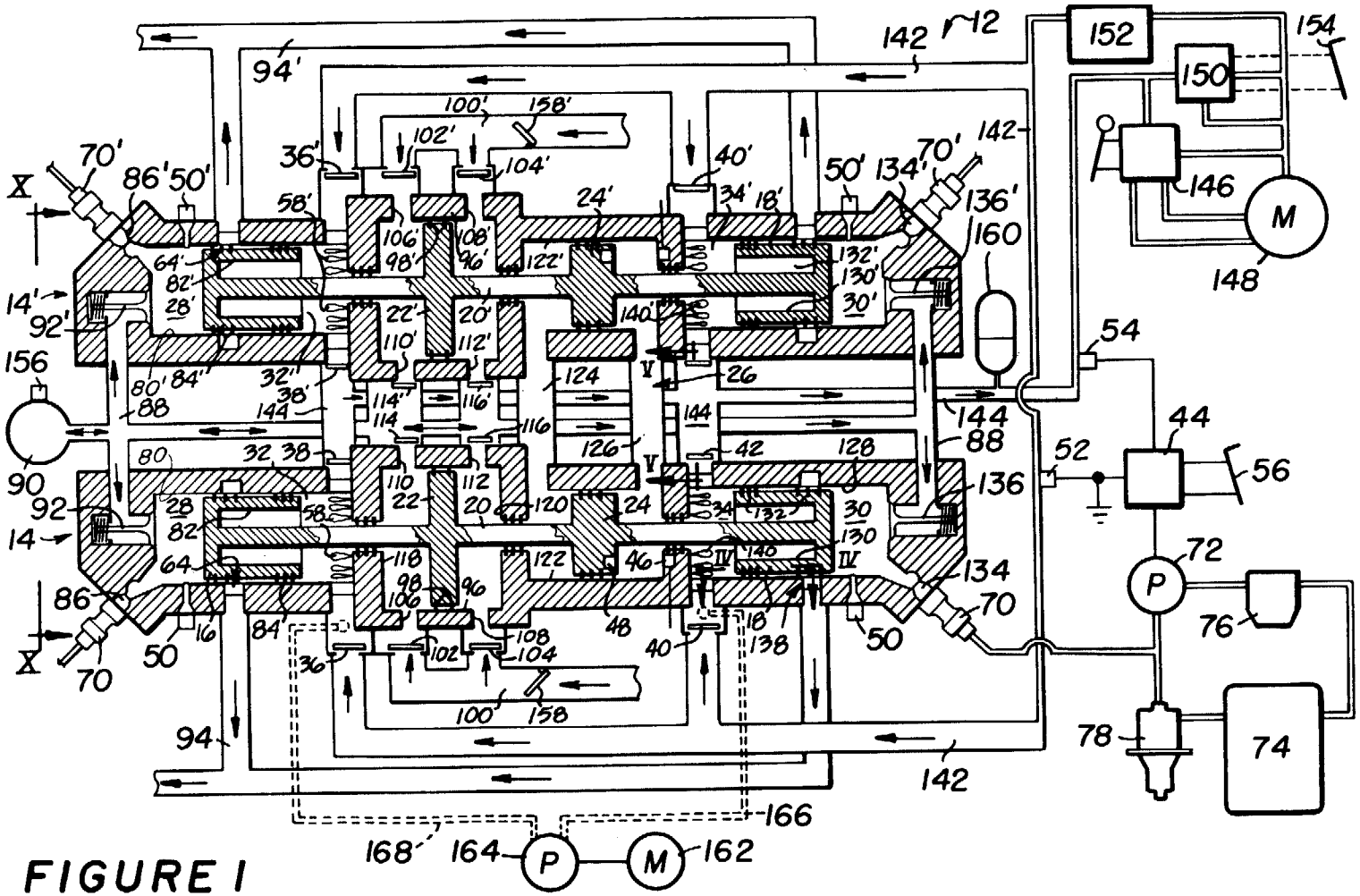
FIG. 1 is a schematic representation, with parts shown in section, of an internal combustion engine or pumping device constructed in accordance with the present invention and including accessory components to adapt the engine or pumping device for operation as the prime mover of a vehicle, the internal engine or pumping device of FIG. 1 being illustrated in a non-operating condition with its internal pistons positioned accordingly.
Figure 2:
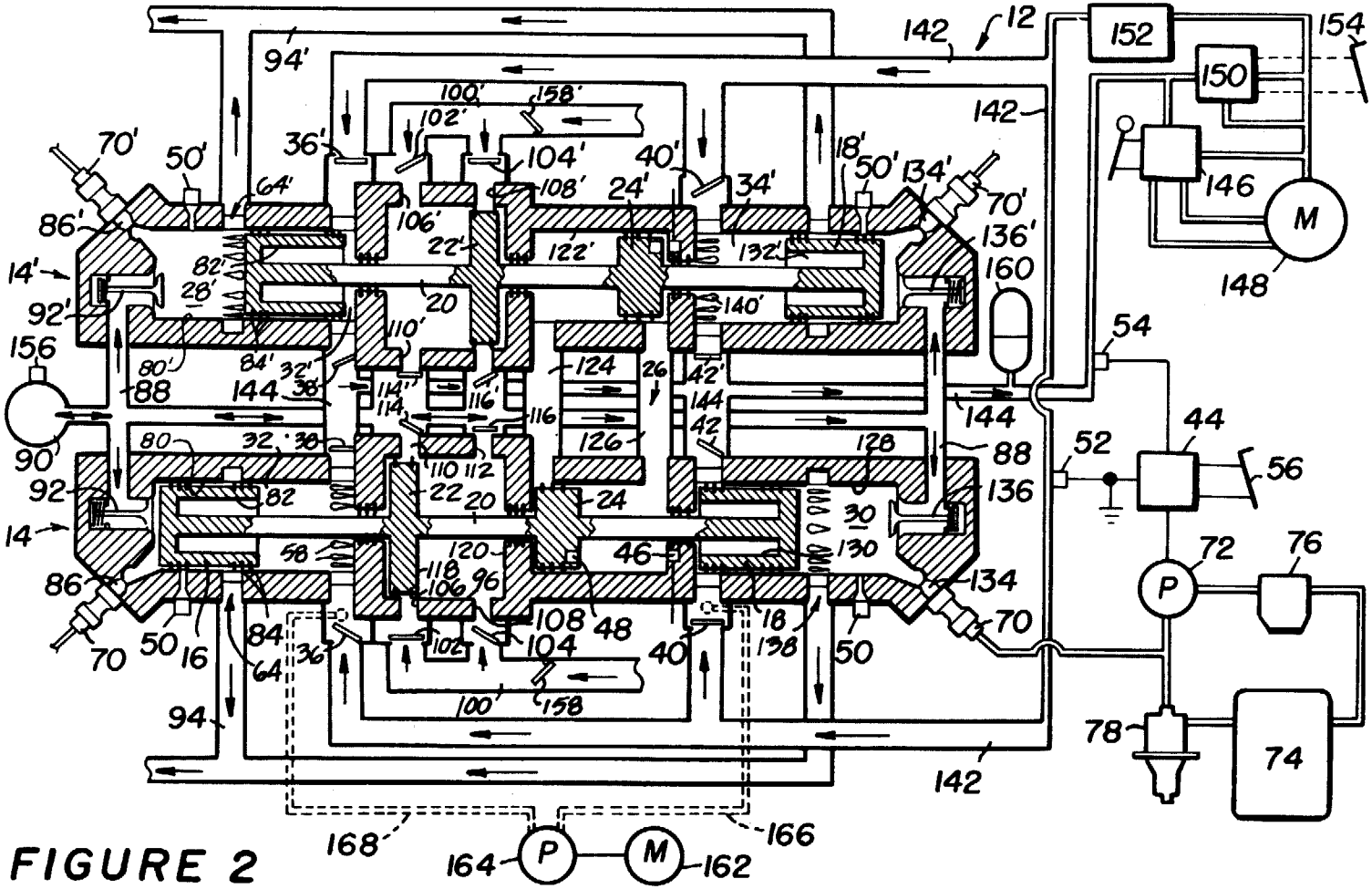
FIG. 2 is a similar view of the engine or pumping device of FIG. 1 with the internal pistons of the engine being positioned at one extreme position.
Figure 3:
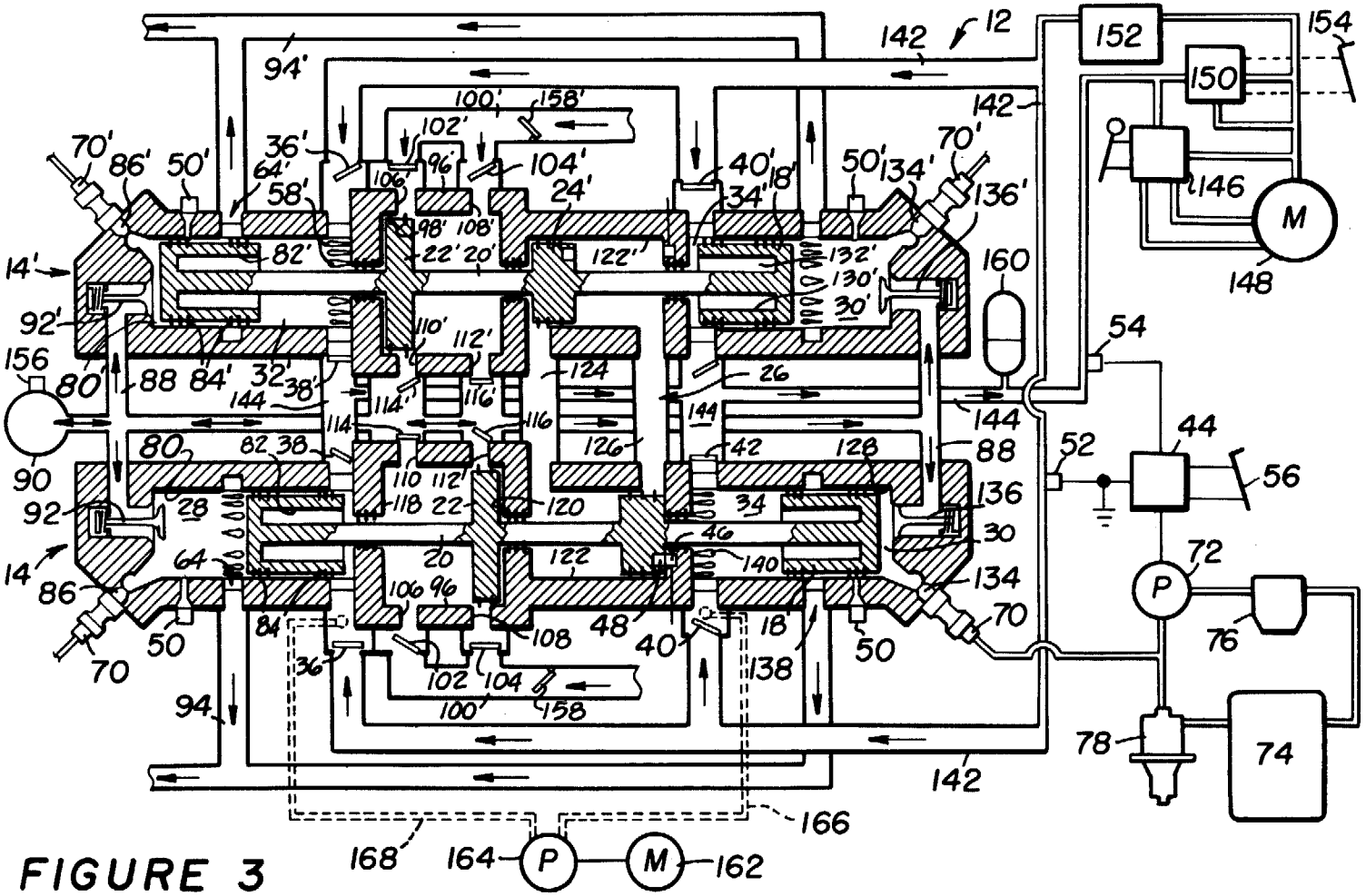
FIG. 3 is also a similar view of the internal engine or pumping device of FIG. 1 with the internal pistons at their opposite extreme position from that illustrated in FIG. 2.
Figure 8:
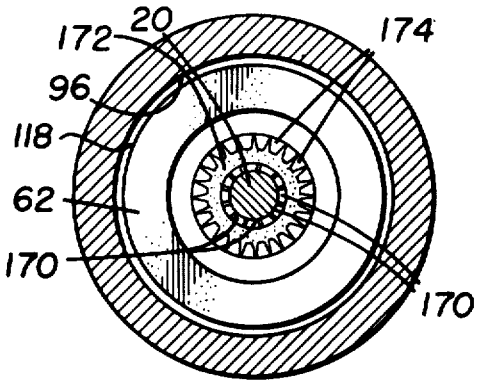
FIG. 8 is a view taken along section line VIII—VIII of FIG. 6 and also illustrating the self-actuating brake in a relaxed position.

According to the present invention and as is best illustrated in FIGS. 1–3, an internal combustion engine or pumping device 12, preferably of a diesel type, includes multiple pairs of mechanically interconnected and opposed double-acting driving/pumping pistons or power elements. Each piston is arranged in an elongated cylinder and divides the cylinder into a combustion chamber and a pumping chamber. Since the multiple pairs of opposed cylinders are of similar construction, only one such pair is described in detail below, the other pair or pairs of cylinders being of similar construction.

Each opposed pair of pistons is preferably arranged in linear alignment and interconnected by means of a common rod or shaft. In the opposed pair indicated at 14, the pistons 16 and 18 are interconnected by means of a rod 20. Each pair of pistons, for example those indicated at 16 and 18, is also interconnected by means of the common rod 20 with a compressor piston 22 serving to supply compressed air to the combustion chambers both for purposes of scavenging exhaust products therefrom and for introducing supercharged air prior to combustion. The pistons 16 and 18 are also interconnected by means of the rod 20 with a synchronizing piston 24, similar sychronizing pistons for two opposed pairs of pistons being interconnected by means of a fluid-filled synchronization circuit 26 for synchronizing operation of all four driving/pumping pistons.

As will be made more apparent from the following detailed description, the pumping chamber serves not only to permit direct interaction with the transmission drive fluid by the piston but also serves to cool the driving/pumping pistons and associated components by the flow of fresh transmission drive fluid through the pumping chambers. The combustion chambers for the pistons 16 and 18 are indicated respectively at 28 and 30 while the pumping chambers for the same pistons are illustrated respectively at 32 and 34.

Within the internal combustion device, pressure-responsive, self-operating inlet and outlet valves are provided for each of the pumping chambers to regulate flow of transmission drive fluid into and out of the pumping chambers during operation of the engine. The inlet and outlet valves for the pumping chamber 32 are indicated respectively at 36 and 38 while the inlet and outlet valves for the pumping chamber 34 are indicated respectively at 40 and 42. As a result of this arrangement, which is described in greater detail below, power produced by combustion within the combustion chambers is transferred directly and instantaneously through the appropriate pistons to the transmission drive fluid within the associated pumping chambers. Thus, the operating load for the engine is transferred directly through the respective pistons. Accordingly, it is important to note that all components of the engine apart from the combined combustion chamber/pumping chamber formed by the cylinder for each piston may be constructed of relatively lightweight material, particularly in comparison with prior art internal combustion engines. At the same time, the engine or pumping device of the present invention may be used to exploit the advantage of higher thermal efficiency resulting from higher compression ratios developed within the compression chambers. Here again, the use of such compression ratios is made possible because of the absence of mechanical linkages between the pistons for transferring the operating load of the engine. For example, with the internal combustion device being a diesel engine as disclosed herein, it operates at normal diesel compression ratios when the engine is under light or no-load conditions. As the load experienced by the engine increases, integral means for regulating combustion and supercharging the combustion chambers permits the use of much higher compression ratios.

In internal combustion engines operating without a supercharger, air is drawn into the combustion chambers at slightly below atmospheric pressure and the volume of air is limited to the swept area of the cylinders. The volume of air available for combustion thus limits the quantity of fuel which can be completely burned during each power stroke and similarly limits the horsepower which can be produced by the engine. Various methods have been employed in the prior art for supercharging such engines; however, all such prior art devices tend to supercharge the cylinders to the same extent for a given operating speed regardless of the instant load imposed upon the engine. This prior art limitation is not a particular disadvantage for an engine running under a constant load. However, it can provide a substantial disadvantage for engines operating under a constantly varying load. Under such varying conditions, the engine experiences a loss in mechanical efficiency resulting from the unnecessary compression of a given mass of air while running under light or no-load conditions, the mass of air being more than sufficient for the complete combustion of the relatively small quantity of fuel introduced into the combustion chamber. The energy required for pressurizing air within the supercharger more than offsets the thermal efficiency gained. Conversely, when an engine is running under full load, the degree of supercharging may not be sufficient to extract the optimum amount of thermal energy from the greater quantity of fuel being introduced into the combustion chambers to meet the higher load requirement.

Current engines are designed to meet a known load curve and they tend to operate inefficiently at loads substantially above or below the design load-curve. At low loads, they consume more fuel than needed. Under high loads they cannot convert enough fuel into thermal energy to efficiently meet the demands imposed by the high engine loads.

The present invention solves this problem without the need for auxiliary compressors or superchargers since the mass of air or degree of supercharging within the combustion chamber prior to each compression stroke is automatically varied to meet the instant load imposed upon the device. The mechanical effort required for compression of the air within the combustion chamber is naturally increased or decreased depending upon the mass of air introduced into the combustion chamber prior to the compression stroke of the piston. Thus, the range of loads under which the present internal combustion engine or pumping device is capable of operating with maximum efficiency is much wider than permitted with conventional internal combustion engines.

High compression ratios are a source of substantial heat which must be dissipated in order to achieve and maintain high engine efficiency. Within the present invention, very efficient heat dissipation is automatically achieved by the continued circulation of the precooled transmission drive fluid through each pumping chamber in direct contact with the piston itself. Accordingly, heat from the piston and the walls of the cylinders forming the pumping chamber and the combustion chamber is carried away by the hydraulic fluid which, at the same time, serves to transmit transmission drive for the engine.

The timing of fuel injection into the various combustion chambers is controlled by an electronic fuel injection system indicated at 44 which in itself is of conventional construction. Principally, the fuel injection system is responsive to signal impulses transmitted from an electromagnet imbedded in a fixed structural part in response to the approach of a magnet imbedded within a movable part for the piston pair. In the piston pair 14, for example, the signal transmitting electromagnet is indicated at 46 while the magnet is indicated at 48. Operation of the fuel injection system is responsive to varying load conditions for example by adjusting the relative strength of the signal from the electromagnet or by varying the position of the electromagnet within the fixed structure in order to achieve the same result. Other conventional timing and regulation devices may also be employed for this purpose.

Other fuel injection controls include temperature sensors 50 preferably in communication with the combustion chambers for each opposed piston pair. The injection control 44 is thus responsive to temperature conditions within the engine for varying the amount of fuel injected for example under either cold starting or normal operating temperatures. Similarly, pressure sensors 52 and 54 are responsive to relatively low pressure of transmission drive fluid introduced into the pumping chambers and relatively high pressure transmission drive fluid exiting the pumping chambers so that the control system 44 is also responsive to the instant load being applied to the engine. At the same time, the injection control 44 is responsive to a manual control means such as the accelerator pedal 56 in order to permit an operator to selectively increase or decrease the rate or quantity of fuel injection to the combustion chambers of the engine.

In internal combustion engines of the type contemplated by the present invention, where travel of the piston is not positively limited by an interconnecting mechanical linkage, piston overtravel resulting, for example, from variations in fuel and air supply, has been a significant problem. In prior art free-piston engines, complex controls and linkages have been necessary to overcome this problem. Within the present invention, a number of relatively simple means are provided as a redundant system to assure that piston travel is always maintained within proper limits. Initially, at least one piston in each opposed piston pair is designed to enter into a compressed air or gas trap as the piston pair approaches either opposite limit of travel. Within the present design, these gas traps are provided in conjunction with the compressor piston 22 since it is of larger area than the other pistons for reasons set forth below. Secondly, the power transmission fluid pressurized within each pumping cylinder enters and exits the pumping cylinder through variable passage means 58 preferably in the form of tear drop-shaped ports. As each piston, for example that indicated at 16, moves toward the pumping chamber in response to combustion within the opposite chamber 28, it progressively closes the tear drop-shaped openings thus providing an increasingly greater force which the piston must overcome as it approaches its limit of travel within the pumping chamber. The arrangement of the tear drop-shaped ports 58 and the gas traps described below in association with the compression piston 22 are synchronized to have a common effect upon movement of all of the pistons connected with the common rod 20.

In connection with the opposed piston pair 14, it may be seen that as the one piston 16 approaches the limit of its power stroke within the pumping chamber 32, the opposite piston 18 is approaching the limit of its compression stroke at which time fuel is injected into the combustion chamber 30 to drive the piston 18 and the other components upon the common rod 20 in the opposite direction. Thus, the arrangement of the tear drop-shaped ports 58 and the gas traps associated with the compressor piston 22 are also synchronized with fuel injection for each of the combustion chambers.

In addition to the above means which hydraulically limit travel of the pistons, other mechanical means are also provided for limiting or arresting travel of the opposed piston pairs. Most important, the present invention includes a novel self-actuating brake system 60 which may be best seen in FIGS. 6–9. The brake system serves to mechanically limit and finally arrest travel of the rod 20 in either direction as it approaches either limit of travel. Because of the mechanical operation of the brake system 60, it is particularly contemplated that travel of the opposed piston pairs be initially resisted and halted by the hydraulic means disclosed above with the brake system 60 serving in a backup manner to assure the absence of overtravel for each opposed piston pair. Similarly, a buffer of heat-resistant energy-absorbent material 62, also illustrated in FIGS. 6–9, is mounted upon a fixed component of the engine as a final means for limiting travel of each opposed piston pair. Although FIGS. 6–9 illustrate only a single brake system 60 and buffer 62 for limiting travel of the piston pair in one direction, it will be apparent that a similar brake system and buffer can also be employed for limiting travel of the same piston pair in the opposite direction.

Finally, before proceeding with a more detailed description of the construction for the present internal combustion engine or pumping device, it is also noted that the engine is provided with variable passage means 64, preferably in the form of tear drop-shaped ports for adjusting back pressure in the combustion chamber during flow of exhaust products therefrom. Referring for example to FIG. 1, it may be seen that the tear drop-shaped ports 64 are uncovered by each piston as it moves away from the combustion chamber during a power stroke. The piston first uncovers the smaller end of the tear drop-shaped ports and then the larger end. Accordingly, the exhaust passage from the combustion chambers is relatively small under light load conditions where the piston experiences less travel out of the combustion chamber and relatively large under relatively heavy load conditions where the piston travels a greater distance out of the combustion chamber and into the corresponding pumping chamber.

A more detailed description of the present internal combustion engine or pumping device 12 is set forth below followed by a description of a preferred mode of operation thereof in order to assure a complete understanding of the invention. As was noted above, the internal combustion engine or pumping device includes a plurality of opposed piston pairs which are of similar construction, one such opposed pair being indicated at 14.

One or more additional opposed piston pairs are also arranged within the engine in accordance with the present invention. For example, referring to FIGS. 1–3, n additional piston pair is illustrated at 14', the opposed piston pair 14' including similar components as the piston pair 14, those similar components being indicated by similar primed numerical labels. It is particularly contemplated that the present internal engine or pumping device be of an eight-cylinder configuration. Referring momentarily to FIG. 10, two additional sets of opposed piston pairs are provided along with the two opposed piston pairs 14 and 14'. The two additional sets of opposed piston pairs are indicated respectively at 66 and 66'. As was also noted above, the two opposed piston pairs 14 and 14' are adapted for operation in opposition to each other in order to overcome the effects of vibration and inertia within the engine. In order to further assure balance within the internal engine or pumping device, the opposed piston pairs 14 and 14' are also adapted for operation in opposition to the other opposed piston pairs 66 and 66' respectively. With the arrangement of FIG. 10, it would of course be possible to synchronize operation of the four opposed piston pairs so that none of the pairs operates simultaneously. However, it is believed sufficient for purposes of maintaining balance within the engine according to the present invention that the two opposed piston pairs 14 and 66' operate simultaneously and in direct opposition to the other two opposed piston pairs 14' and 66 which also accordingly operate simultaneously. Finally, it is noted that the other two opposed piston pairs 66 and 66' also include similar components as will be described immediately below for the one opposed piston pair 14.

With continued reference to FIG. 10 as well as FIGS. 1–3, it may be seen that the four opposed piston pairs 14, 14', 66 and 66' are arranged within a common engine block 68. Similar fuel injectors 70 are adapted for operation in response to the fuel injection control system 44 for supplying fuel to the respective combustion chambers at opposite ends of each opposed piston pair. As may also be seen in FIGS. 1–3, each injector 70 is associated with the fuel injector pump 72 which operates in direct response to the fuel injection control system 44. As in conventional construction for such fuel injector systems, each fuel injector pump 72 is arranged for drawing fuel from a common reservoir or tank 74 through an appropriate filter 76, pressure equalizing means 78 also being provided in communication with each injector and the tank 74.

The construction of the one opposed piston pair 14 is described in detail immediately below and it is to be kept in mind that the other opposed piston pairs 14', 66 and 66' are of similar construction.

In each of FIGS. 1–3, each combustion chamber 28 and associated pumping chamber 32 are formed by an elongated cylinder 80 within which the piston 16 is arranged for reciprocation. The piston 16 is of hollow construction having its interior surfaces 82 in communication with the pumping chamber 32 in order to permit cooling of the piston by flow of transmission drive fluid therethrough. The piston 16 is also equipped with two sets of conventional rings 84 in order to insure sealing between the combustion chamber 28 and pumping chamber 32. The two spaced-apart sets of seal rings as indicated at 84 prevent leakage from either of the combustion or pumping chambers into the other. Rather, combustion gas leakage from the combustion chamber or any leakage of transmission drive fluid from the pumping chamber is communicated into the exhaust passages 64 and thus carried out of the engine.

Fuel is supplied to the combustion chamber 28 from the associated injector 70 through a passage 86. Air is supplied to the combustion chamber 28 from a common air supply conduit 88 formed by the engine block and including a common manifold 90. The common air supply conduit 88 and manifold 90 are placed in communication with the combustion chamber 28 by means of a pressure responsive valve 92 which opens when the combustion chamber 28 is vented through the exhaust passage 64, causing the combustion chamber pressure to drop below the engine manifold pressure which is substantially greater than atmospheric pressure. The tear drop-shaped ports 64 are arranged about the periphery of the cylinder 80 in communication with a common exhaust passage 94.

As was noted above, a supply of compressed air is introduced into the common air supply conduit 88 by operation of the compressor piston 22 within its elongated cylinder 96. The piston 22 is also equipped with conventional rings 98 for maintaining sealing engagement with the cylinder 96 during reciprocating movement therein. Opposite ends of the compressor cylinder 96 are in communication with the atmosphere through a supply conduit 100 and respective valves 102 and 104 which open into opposite ends of the cylinder 96 through respective passages 106 and 108. The opposite ends of the compressor cylinder 96 are similarly in communication with the internal air supply conduit 88 and manifold 90 by means of respective passages 110 and 112 and valves 114 and 116. The valves 102, 104, 114 and 116 are all self-actuating, pressure responsive valves which function during reciprocation of the piston 22 for introducing low pressure air into the compressor cylinder 96 and for supplying compressed air into the internal air supply 88 and manifold 90.

It is important to note that the outlet ports 110 and 112 are formed in spaced-apart relation from the respective ends 118 and 120 of the compressor cylinder 96. The space between each port and the adjacent cylinder end defines the gas trap referred to above for limiting travel of the piston 22 and accordingly travel of the assembly mounted on the common rod 20 in either axial direction.

Finally, in connection with the compressor cylinder 96, it may be seen that both the cylinder 96 and piston 22 have a diameter or effective area substantially greater than the combined area for the corresponding combustion chambers 28 and 30. This insures that the compressor piston 22 is capable of supplying air under pressure to the combustion chambers even under low or no-load conditions.

The synchronizing piston 24 is arranged for reciprocation within the synchronizing cylinder 122. The synchronization circuit 26 referred to above includes passages 124 and 126 which are in respective communication between opposite ends of the synchronizing cylinder 122 and the synchronizing cylinder 122' in the other opposed piston pair 14'. With the synchronization circuit 26 being completely filled with an incompressible fluid, synchronized movement of the pistons 24 and 24' serves to synchronize opposed movement for the two piston pairs 14 and 14'.

Before describing the transmission drive fluid circuit for the engine, it is noted that the combustion chamber 30 and pumping chamber 34 at the opposite end of the piston pair 14 is similarly formed by an elongated cylinder 128, the piston 18 similarly being of generally hollow construction with its interior surfaces 130 in communication with the pumping chamber 34. The piston 18 is also equipped with spaced-apart ring sets 132 to maintain a seal between the combustion chamber 30 and exhaust ports 64 and between the pumping chamber 34 and exhaust ports 64. Fuel is introduced into the combustion chamber 30 through a fuel passage 134 while air is introduced into the combustion chamber 30 from the air supply conduit 88 and manifold 90 by means of a pressure responsive, self-operating valve 136. The cylinder 128 is also formed with a cylindrical arrangement of tear drop-shaped exhaust ports 138 for regulating the flow of exhaust gases out of the combustion chamber 30 in the same manner described above for the combustion chamber 28.

Hydraulic transmission fluid is supplied to the pumping chambers 31 and 34 from a common low pressure supply conduit 142 through the respective inlet valves 36 and 40. At the same time, the flow of transmission drive fluid into the pumping chamber 32 is regulated by the cylindrically arranged variable inlet ports 58 while a similar arrangement of tear drop-shaped variable inlet ports 140 regulates the flow of transmission drive fluid into the other pumping chamber 34. It is to be noted that the tear drop-shaped ports 58 and 140 not only serve to admit transmission drive fluid into the pumping chambers 32 and 34 but also serve to communicate transmission drive fluid under pressure from the pumping chambers 32 and 34 through the outlet valves 38 and 42. The outlet valves 38 and 42 are in turn in communication with a common high-pressure conduit 142.

Transmission drive fluid supplied into the high pressure conduit 144 is communicated to a directional control valve 146 which regulates communication of the high-pressure and low-pressure conduits 144 and 142 with a suitable hydraulic motor 148 for determining the direction of operation of the motor. The directional control valve 146 may also be conventionally equipped with a neutral position. With the directional valve 146 being in its neutral position, high pressure fluid from the conduit 144 is directed through a restrictor valve 150. The restrictor valve 150 automatically opens or closes as the demand load for the engine varies in order to reduce or increase the flow of pressurized transmission drive fluid from the high-pressure conduit 144 into the low pressure conduit 142.

A radiator 152 is also preferably arranged in the low pressure return conduit 142 in order to insure that the transmission drive fluid is at a sufficiently low temperature upon entering the pumping chambers in order to properly carry away heat from the power/pumping pistons and associated cylinder components.

The components described immediately above as accessories for the present internal combustion engine or pumping device are particularly contemplated for use with the engine being a prime mover for a vehicle. In such an arrangement, the restrictor valve 150 also provides a novel means for achieving braking. For example, the restrictor valve 150 may be coupled with a manually operated brake element or pedal 154 as another means for decreasing the return of transmission drive fluid to the pumping chambers.

In addition to the control components described above, additional controls are also provided for facilitating various operating conditions of the engine such as starting conditions and the like. Initially, devices are well known in the prior art to advance or retard the timing of such an internal combustion engine in accordance with operating conditions of the engine. For this purpose, a sensor 156 is also in communication with the fuel injection control 44 and preferably comprises a diaphragm-operated advance unit for sensing pressure changes within the air intake manifold 90 for the combustion chambers. The advance unit could also be located within the air intake of the air compressor.

A choke plate 158 is also preferably arranged within the atmospheric air supply conduit 100 for the compressor cylinders such as that indicated at 96. Although separate inlet conduits 100 are illustrated for the various compressor cylinders, a common inlet manifold could also be provided permitting use of a single choke plate 158 for regulating air supply to the entire engine. Under conditions of light or no-load, the choke plate 158 would be progressively closed by a spring load. Accordingly, the volume of air drawn into the compressor cylinders would be approximately equal under varying load conditions but there would be a resultant lowering of the pressure below atmospheric under such light load conditions. The compressor would then be operating in a partial vacuum. However, the design of the compressor chambers, including their relative size as referred to above, would assure delivery of air into the internal supply conduit 88 and manifold 90 at pressures above atmospheric. On the other hand, the choke plate 158 progressively opens under conditions of increasing load in order to increase the amount of super-charging occurring within the compression chambers.

Pulsation and consequent vibration within the high pressure outlet conduit 144 is effectively prevented by means of a dampening chamber or accumulator 160 arranged in communication with the high pressure outlet conduit 144 for the transmission drive fluid.

It will be apparent that when the engine 12 of the present invention is shut down, pressures will tend to equalize in opposite ends of the various chambers so that the opposed piston pairs will tend to assume the centered positions illustrated in FIG. 1. In order to reposition the pistons for start-up, a small electric motor 162 operated for example by a battery (not shown) drives a pump 164 for drawing fluid out of the pumping chamber 34 at one end of the opposed piston pair 14 and supplying it to the pumping chamber 32 at the opposite end through conduits 166 and 168. At the same time, the motor 162 is effectively coupled with the inlet valve 40 for the pumping chamber 34 and the outlet valve 38 for the other pumping chamber 32 in order to maintain them in closed positions under such conditions. Thus, reduced pressure in the pumping chamber 34 and increased pressure in the pumping chamber 32 tends to shift the pistons 16 and 18 leftwardly as viewed in FIG. 1 in order to produce a compression stroke within the combustion chamber 28 and permit internal combustion to be initiated therein to achieve start-up of the engine. Similar start-up components would also be provided for the other opposed piston pairs.

Figure 6:
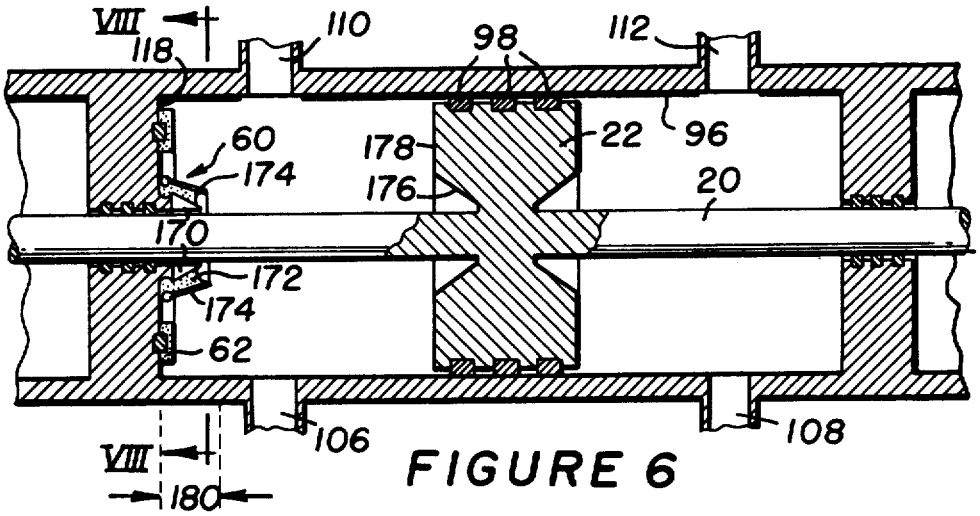
FIG. 6 is a fragmentary view of a portion of the internal combustion engine or pumping device of FIG. 1 including a piston arranged within a cylinder and incorporating a self-actuating brake for limiting linear travel of the piston, the brake being illustrated in a relaxed position.

The self-actuating brake referred to at 60 in FIGS. 6–9 is preferably arranged within the compressor cylinder 96 and it is to be noted that a similar self-actuating brake could be arranged at the opposite end of the compressor cylinder for limiting movement of the piston 22 and common rod 20 in the opposite direction. The brake system 60 includes a plurality of radially movable metal brake shoes 170 mounted upon the end surface of the compressor chamber and arranged about the common rod 20. A collar 172 formed from a compressible resilient material circumferentially surrounds the brake shoes 170 for interaction with a circumferential arrangement of hinged or resilient fingers 174. The arrangement of the brake shoes 170, collar 172 and fingers 174 is selected so that, in the relaxed condition illustrated in FIG. 6, the fingers 174 present a conical configuration suitable for interaction with a conical recess 176 formed in the adjacent face 178 of the compressor piston 22. With such an arrangement, travel of the common rod 20 and compressor piston 22 leftwardly as viewed in FIG. 6 is initially resisted by development of a gas trap or spring chamber produced by the spaced-apart relation between the outlet passage 110 and the adjacent end surface 118 of the compressor chamber.

As noted above, the variable outlet ports for the pumping chambers also serve to limit axial travel of the common rod 20 and the compressor piston 22. If these hydraulic components are not entirely capable of limiting travel of the opposed piston pair including the common rod 20 and compressor piston 22, gradual braking force is applied as the conical surface 176 engages the fingers 174 which then act through the resilient collar 172 to force the brake shoes 170 against the rod 20. The force thus applied to the brake shoes 170 progressively increases until substantial braking pressure is applied to the rod 20 as the piston 22 approaches the end surface 118 of the compressor cylinder 96. At that time, the compressor piston 22 also engages the buffer 62 in order to provide a positive means for limiting travel of the opposed piston pair.

Figure 9:
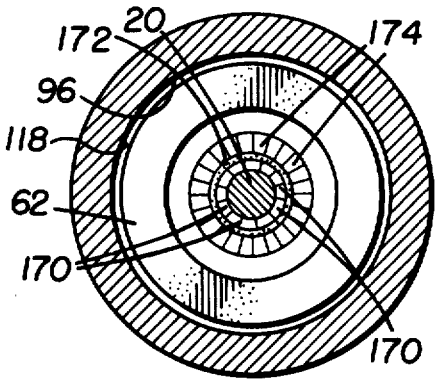
FIG. 9 is similarly a view taken along section line IX—IX of FIG. 7 while illustrating the brake in an actuated condition.
Figure 7:
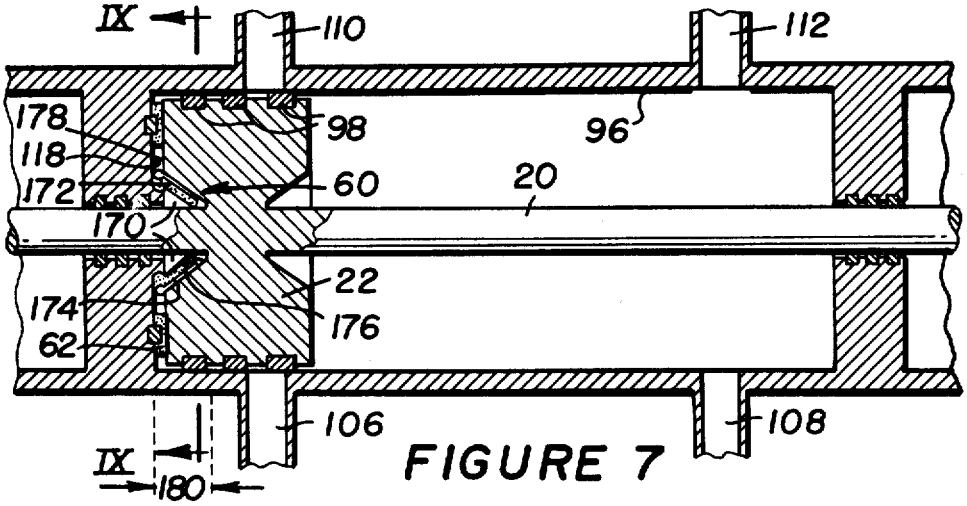
FIG. 7 is a similar view of the piston and cylinder of FIG. 6 with the brake being illustrated in an actuated position corresponding to an extreme limit of travel for the piston within the cylinder.

Movement of the compressor piston 22 into a position adjacent the end surface 118 resulting in full engagement of the brake shoes 170 is illustrated in FIG. 7 where the face 178 of the compressor piston 22 is also illustrated in contact with the resilient buffer ring 62. The construction and arrangement of the components within the brake system 60 is illustrated in a relaxed condition in FIG. 8 which corresponds to the illustration of the brake system in FIG. 6. Similarly, FIG. 9 is a section view taken from FIG. 7 to illustrate the brake system in an actuated condition for arresting movement of the rod 20.

Operation of the internal combustion engine or pumping device 12 of the present invention is believed obvious from the preceding description but is also briefly described below in order to assure a complete understanding of the invention.

Start-up of the engine is commenced with the components of the engine in the position illustrated in FIG. 1. Preferably, start-up is accomplished through operation of the motor 162 as described above in order to shift the opposed piston pair rod 20 completely to the left. At the same time, the piston 20' for the other opposed piston pair 14' would be shifted to the right in the following description, it will be apparent that the opposed piston pair 14' is always operating substantially in full opposition to the piston pair 14.

With the rod 20 shifted completely to the left as illustrated in FIG. 2, the valves 40 and 38 are released following the introduction of transmission drive fluid into the pumping chamber 32. At the same time, combustion is initiated within the chamber 28 driving the piston 16 and other components of the opposed piston pair 14 to the right as viewed in FIGS. 1–3. This movement serves to expel high pressure transmission drive fluid from the pumping chamber 32 into the high pressure outlet conduit 144. At the same time, transmission drive fluid is drawn into the other pumping chamber 34 from the low pressure conduit 142 and the piston 18 is driven in its compression stroke for compressing air supplied into the combustion chamber 30 from the air supply conduit 88 and air supply manifold 90.

Rightward travel of the rod 20 is limited by both hydraulic and mechanical means similar to those described above. At the same instant, combustion is initiated within the combustion chamber 30 in order to drive the opposed piston pair mounted upon the common rod 20 in the opposite direction. Once combustion is initiated in both of the chambers 28 and 30, reciprocating operation for the opposed piston pair 14 is under way. Air is also drawn into the compressor 96 and supplied under pressure to the internal conduit 88 and manifold 90. Also during operation, fluid within the synchronizing circuit 26 assures proper opposed operation for the piston pairs 14 and 14'. The fuel injector control 44 is responsive to the various sensors described above for maintaining the proper timing and volume of fuel introduction into the various combustion chambers. Accordingly, the engine operates in balanced reciprocating motion between the positions illustrated in FIGS. 2 and 3 in order to achieve the advantageous mode of operation contemplated by the present invention.

During operation, certain features of the present internal combustion engine 12 are of particular importance. For example, this includes the various hydraulic and mechanical means for limiting piston overtravel. One such feature includes the tapered outlet ports such as those indicated at 58 for the pumping chamber 32.

Also during operation of the engine, it is important to note that compressed or supercharged air from the compressor cylinder 96 is supplied through the internal conduit 88 and manifold 90 into each combustion chamber as exhaust from the chamber commences through the variable outlet ports such as those indicated at 64. In this manner, air from the passage 88 serves initially to scavenge exhaust gases from the combustion chamber and to cool the walls of the combustion chamber while filling with a fresh supply of air under an appropriate supercharged pressure. Thus, each driving/pumping piston is cooled both by the flow of transmission drive fluid through its associated pumping chamber and by the flow of compressed air through its combustion chamber during exhaust. With a fresh supply of air then being present within the combustion chamber during the compression stroke of the piston, suitable combustion conditions are created at the time fuel is injected into the combustion chamber.

When the engine is stopped, pressures in the combustion chambers at opposite ends of each piston pair tend to equalize at a supercharged pressure, the opposed piston pairs tending to again assume the central position illustrated in FIG. 1. Under those conditions, the start-up operation described above may again be followed in order to commence operation of the engine.

It will be apparent various modifications will be obvious within the scope of the present invention. For example, one such modification is illustrated in FIG. 5. Referring to FIG. 5, it may be seen that the valves 38 and 38' are integrally interconnected and preferably formed as portions of a spool or shuttle valve 182. In this manner, the valves 38 and 38' will continue to function in the same function described above for regulating the flow of high pressure drive fluid from the respective pumping cylinders 32 and 32' into the common high pressure conduit 144. At the same time, the shuttle valve 182 is also adapted to provide fuel under pressure for supply to the various combustion chambers. For that purpose, the shuttle valve 182 is formed with a shaft 184 serving to interconnect the valves 38 and 38' which include seal rings 186 for sealing engagement with a common cylindrical wall 188. The shaft 184 also penetrates a wall 190 which forms separate pumping chambers 192 and 194. Poppet valves 196 and 198 serve to connect a fuel supply conduit 200 respectively with the two pumping chambers 192 and 194. Similarly, poppet valves 202 and 204 interconnect the respective pumping chambers 192 and 194 with a fuel outlet passage 206.

In operation, as the shuttle valve shifts in an upward direction, expansion of the pumping chamber 192 causes the valve 196 to open, permitting fuel to enter the pumping chamber 192. As the shuttle valve moves in a downward direction, constriction of the pumping chamber 102 causes the valve 196 to close and the other valve 202 to open. Thus, fuel under pressure is supplied to the outlet conduit 206. At the same time, downward motion of the shuttle valve results in expansion of the other pumping chamber 194 which causes the valve 204 to close and the valve 198 to open. Thus, a supply of fuel is drawn into the pumping chamber 194 until the shuttle valve 182 reaches its downward limit of travel. Thereafter, upward travel of the shuttle results in expulsion of fuel from the pumping chamber 194 past the valve 204 and into the conduit 206. Continued reciprocable action of the shuttle valve 182 results in a continued supply of fuel under pressure to the outlet conduit 206.

Other modifications and variations for the present invention will also be apparent from the preceding description. Accordingly, the scope of the present invention is defined only by the following appended claims.

What is claimed is:

1. A mechanical, self-actuating brake for limiting relative longitudinal travel between first and second movable members along their axes, said first movable member being formed with a conical recess adjacent said second movable member and having a shaft extending toward said second movable member, said second movable member comprising a plurality of circumferentially arranged brake shoes in radial alignment with said shaft, a plurality of fingers being arranged radially about said brake shoes and including resilient means, said fingers being adapted for interaction with said conical recess and with said brake shoes through said resilient means for forcing said brake shoes into braking engagement with said shaft as said first member axially approaches said second member.

2. The self-actuating brake of claim 1 wherein said second member forms an opening between said brake shoes for receiving the shaft of said first member.

3. The self-actuating brake of claim 1 wherein said resilient means comprises a resilient collar interposed between said movable fingers and said brake shoes.

4. The self-actuating brake of claim 1 further comprising an annular resilient buffer arranged for interaction between said first and second members as they approach each other.

* * * * *